United States Patent [19]

Wright, III

[11] 4,371,369

[45] Feb. 1, 1983

[54] AUTOMATIC REGISTER SYSTEM FOR DIE CUTTING OPERATIONS

[75] Inventor: Vester L. Wright, III, Indianapolis, Ind.

[73] Assignee: Franklin Corrugated Design, Inc., Franklin, Ind.

[21] Appl. No.: 143,920

[22] Filed: Apr. 25, 1980

[51] Int. Cl.[3] ..... B31B 1/74

[52] U.S. Cl. ..... 493/373; 493/83

[58] Field of Search ..... 493/472, 342, 373, 82, 493/83; 76/107 C, 107 R; 83/136, 139

[56] References Cited

U.S. PATENT DOCUMENTS

| | | | |
|---|---|---|---|
| 2,779,257 | 1/1957 | Jedlick | 493/342 |
| 3,060,776 | 10/1962 | Bobst et al. | 493/342 X |
| 3,249,272 | 5/1966 | Scarpa | 493/373 X |
| 3,653,304 | 4/1972 | Lenoir | 493/342 X |
| 3,786,731 | 1/1974 | Bobst et al. | 493/373 |
| 3,848,494 | 11/1974 | Gargrave et al. | 76/107 C X |
| 4,175,477 | 11/1979 | Inose et al. | 493/373 X |

FOREIGN PATENT DOCUMENTS

| | | | |
|---|---|---|---|
| 255865 | 12/1964 | Australia | 76/107 C |

*Primary Examiner*—James F. Coan

*Attorney, Agent, or Firm*—Woodard, Weikart, Emhardt & Naughton

[57] ABSTRACT

A stripping die assembly for a stripper in an in-line flat-bed press die cutting system, is prepared for installation in the press as an assembly, and removal from the press as an assembly. Upon installation, the stripping station of the press is essentially closed to enable securing the stripping die to its stationary support, and the movable template to its support before any disassembly of the stripping die from the template. After attachment to the respective press machine stripping station members, fasteners are removed to enable separation of the stripping die from the template, in perfect alignment. Following completion of a run of die cut products, the stripping station is again closed to the stripping position. Then the stripping die and template are again secured together while still attached to the press and in perfect alignment. After being secured together, they are disconnected from the stripping station of the press and returned to storage in exact alignment with each other, ready for installation the next time pieces are needed of the same die cut pattern.

9 Claims, 7 Drawing Figures

AUTOMATIC REGISTER SYSTEM FOR DIE CUTTING OPERATIONS

BACKGROUND OF THE INVENTION

1. Field of the Invention

This invention relates generally to die cutting operations for corrugated board or the like, and more particularly to means and the method for setting-up in-line stripping apparatus in die cutting operations with flat-bed cutting presses.

2. Description of the Prior Art:

Although there are several systems for manufacture of die cut products in paper, cardboard, and corrugated board, one of them of particular interest with reference to the present invention is a system using flat-bed die cutting presses. One brand of press is the Bobst Press. Some general illustrations of major portions of such presses are shown in U.S. Pat. Nos. 3,060,776 and 3,998,452. These illustrate stripping devices intended to strip waste pieces from a sheet of board which has been cut by a cutting die. The press is arranged so that cutting dies of various configurations can be used with it to make die cut pieces of different shapes, the shape depending upon the particular die being used in the press at any given time. For effective stripping of waste from the board, stripping apparatus matching the cutting die, must be used in the stripping station. Typically, such stripping apparatus has included at least a female stripping board or template which has ejection holes at the locations where waste is to be punched from the die cut sheet. This is mounted immediately below the plane of travel of the sheet through the press, and in line with the direction of travel of the sheets through the press. Appropriate punches are mounted to a grid or grating above the sheet path so that as the template is raised by an appropriate mechanism, the punches punch the waste from the sheet. In some of the most recent presses, the template is stationary and the punches descend to punch the waste from the sheet.

It is necessary to align the punches with the ejection holes in order to enable the punches to pass into the holes as necessary for the stripping function. This is normally done by visually aligning the punches with the template holes after the template has been secured in the press, whereupon the punches can be located and attached to the grid by appropriate clamps. Since this can be a very painstaking and time consuming procedure, resulting in considerable down-time of the press, a more convenient way has been devised which involves premounting the punches or stripping blocks to a stripping board, with the board being mounted to the grid. Although this has saved some time, visual alignment has remained necessary to be sure that all of the punches are visually aligned with the corresponding ejection holes in the template. Then, after the stripping die and the template have been lined up on their respective upper and lower supports, the machine must be carefully manually jogged to close the stripper die with the template to verify that proper alignment has been achieved, and thereby avoid damage to these components or faulty stripping, once the machine is activated for a production run. This procedure, although effective to save some time by comparison with the previously described procedure, is nevertheless, somewhat time consuming and demanding of operator skill. The present invention is directed toward an improvement in terms of reduced requirements of skill and time.

SUMMARY OF THE INVENTION

Described briefly, according to a typical embodiment of the present invention, a stripping die including a board and stripper blocks or punches, is cut and matched and assembled with a female stripping board or template separate from the stripping station of the press. This assembly is made from a pattern made from the cutting die and bears reference marks so that when installed in the stripping station of the press, it will be precisely aligned with the cutting station. In addition, means are provided to facilitate retention of the stripping die and template in assembly during installation into the stripping station of the press so that precise alignment of these two parts will be maintained at all times. The mounting thereof in the press is accomplished while the stripping die and template remain assembled and the movable members of the press are moved to position normally achieved during the stripping operation, whereupon the stripping die is affixed to the grid of the stripping station in the press, and the template is affixed to the support bars of the press and, only after this has been done, are the means removed which had theretofore secured the stripping die and template together.

After the press has completed a run of the particular pattern involved, the movable members of the press are again moved to the stripping position, whereupon the stripping die and template are affixed together and then released from the stripping station of the press and returned to storage.

BRIEF DESCRIPTION OF THE DRAWINGS

Referring now to the drawings.

DESCRIPTION OF THE PREFERRED EMBODIMENT

Figure 1:
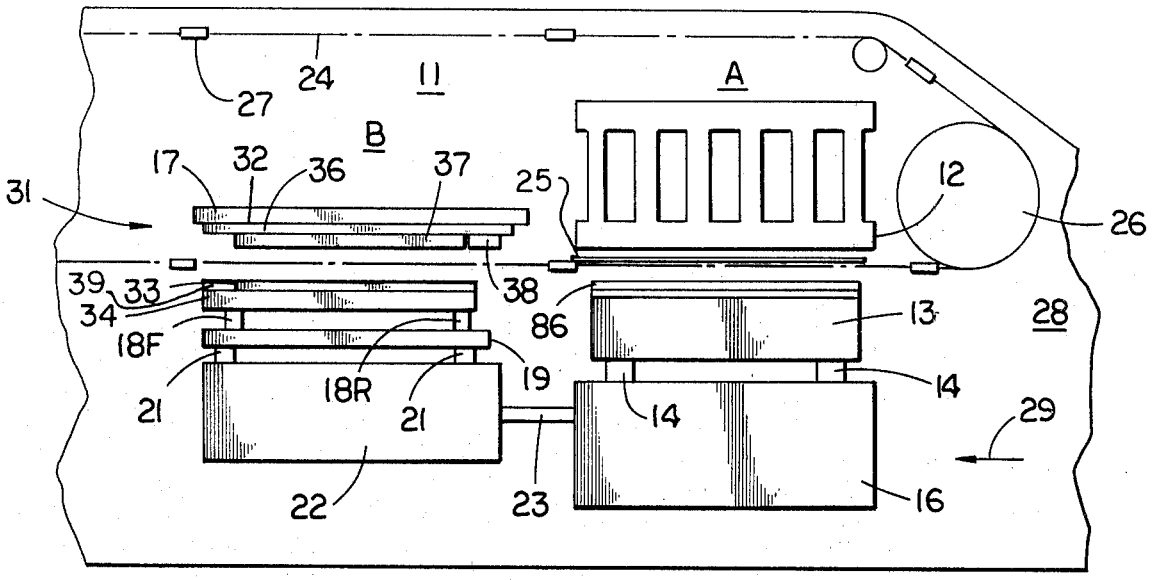
FIG. 1 is a fragmentary schematic elevational view of a portion of a Bobst flat-bed press showing the cutting station and stripping station with stripping means therein according to a typical embodiment of the present invention and shown in the open, non-stripping position.

Referring now to the drawings in detail, and particularly FIG. 1, there is shown schematically a Bobst Press 11 of a type more fully described in U.S. Pat. Nos. 3,060,776 and 3,998,452. It includes a cutting station A and a stripping station B. In the cutting station, an upper stationary platen 12 is provided above a lower reciprocable platen 13 vertically drivable by suitable members 14, driven by a mechanism in housing 16. The stripping station includes a stationary stripping die support member 17, and vertically reciprocable template support bars 18 secured to a support frame 19, the latter being vertically reciprocable by members 21 operated in synchronism with the members 14, by a mechanism in housing 22, driven by synchronizer 23 driven by the mechanism in housing 16. It should be kept in mind that in some new presses, the lower platens are stationary and the upper ones are movable in the cutting and stripping station. For convenience, the type shown in the above mentioned patents is shown and described here, but the present invention is equally applicable to the newer type.

A pair of horizontally spaced endless chains, of which chain 24 is shown in the drawing, is provided and driven by a pair of horizontally spaced sprockets (not shown) at the exit end of the machine, and supported by appropriate idler sprockets and sprockets such as 26 at the entrance end of the machine. These chains support a series of longitudinally spaced, transversely extending gripper bars 27, which grip sheet stock such as sheet 25, on a sheet-by-sheet basis as it is fed into the grippers by a feeding mechanism (not shown) at the entrance end 28 of the press. Accordingly, the chains are driven intermittently in a direction to drive the lower runs of the chains in the direction of arrow 29 from the entrance end toward the exit end of the machine. This action is synchronized with the operation of the mechanism in housings 16 and 22 in the die cutting and stripping stations, respectively, of the press.

The male stripping die 31 is secured to a grid 32 in the support member 17, and the template 33 is secured to a pair of horizontally spaced longitudinally extending support rails 34, with the rails being secured to the pair of previously mentioned transverse template support bars 18 of the stripping station of the press.

In FIG. 1, the stripping die 31 includes a stripping board 36, which is affixed to the grid 32 and has two side trim stripper blocks 37 and 38 showing in FIG. 1. These are above the plane of the lower run of the gripper bar chains. Also, they are stationary. For the stripping action, the mechanism 22 drives the support frame 19 upward, whereupon the bars 18 therein, drive the template upward toward the stripping die to the position shown in FIG. 2, where the major portion of the length of the template has moved up inside a space, which is in-part, framed by the side trim stripper blocks 37 and 38. Only a pair of ears 39 on the template can be seen in FIG. 2, as these extend laterally in front of the side trim stripper blocks as can be best seen in FIG. 3.

Figure 3:
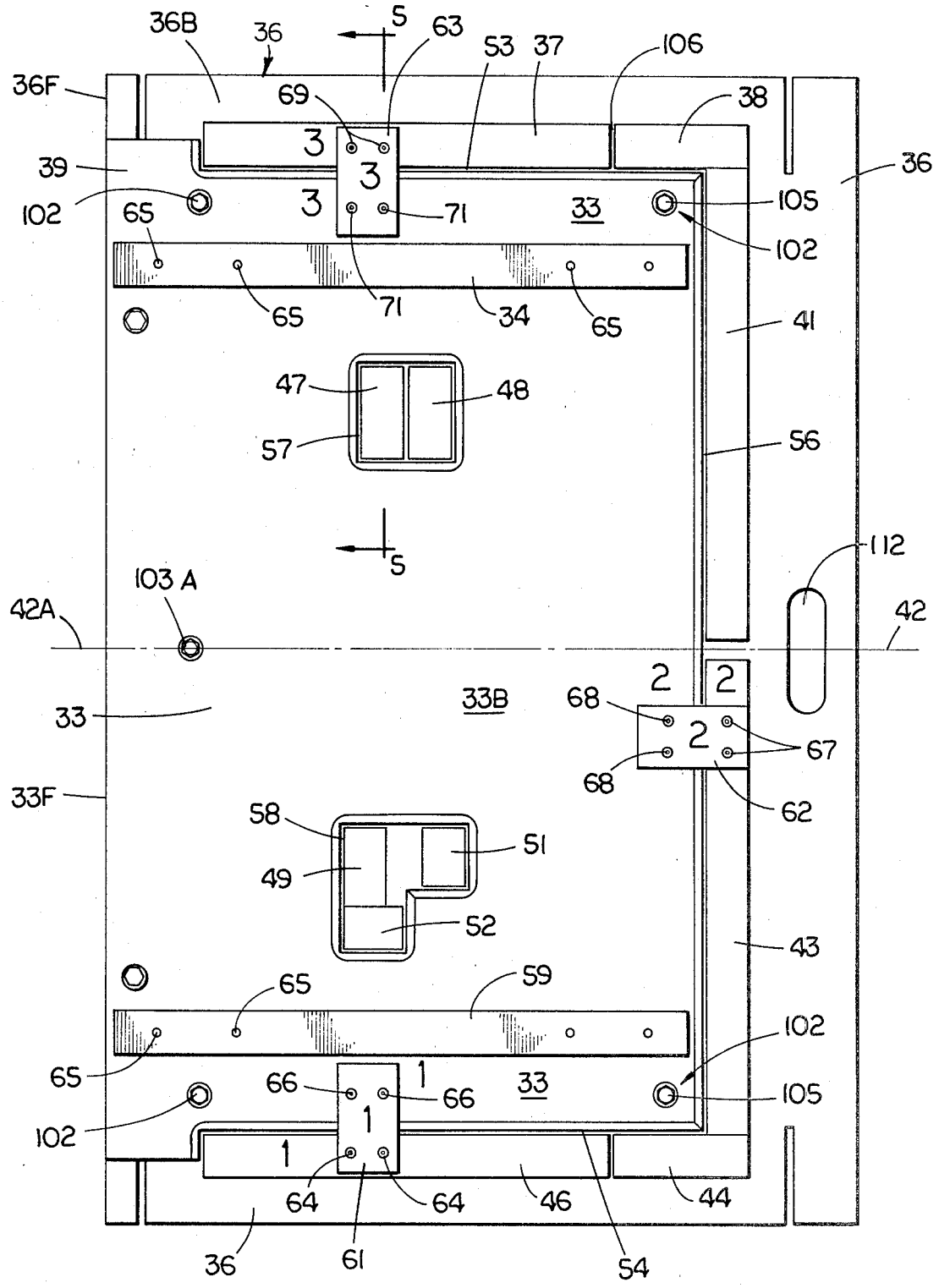
FIG. 3 is a bottom plan view on a much larger scale than FIG. 1 and showing the stripping die and template assembly according to a typical embodiment of the present invention.

Referring further to FIG. 3, the illustrated male stripping board 36 is a rectangular board of ⅝ inch thick hardwood plywood. It has the previously mentioned side trim stripper blocks 37 and 38, secured thereto by gluing and nailing. These blocks are 1 and ⅜ inch wide and 1 and 3/8 inch high (thick) hardwood plywood. Board 36 has a rear trim stripper block 41 of the same kind of material secured thereon in the same way. The board has a center line 42 thereon and another rear trim stripper block 43 and side trim stripper blocks 44 and 46 thereon in the same way and in the same relation to the center line 42, as are the blocks 41, 38 and 37, respectively.

Additional stripper blocks 47 and 48 of the same height as those previously described, are fixed to the board at a location as shown. Likewise, blocks 49, 51 and 52 are affixed to the board 36 at the locations shown in FIG. 3.

Figure 2:
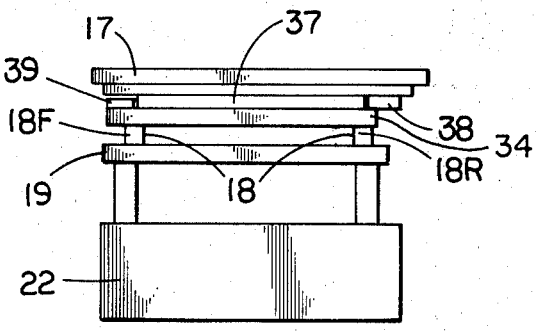
FIG. 2 is a fragmentary schematic elevation of the stripping station of FIG. 1 but with the stripping means closed in the stripping position.

The template is also a generally rectangular hardwood plywood board and is about ½ inch thick. The side edges 53 and 54 are shown inboard of the side trim stripper blocks of the stripping die and the rear edge 56 is inboard of the rear trim stripper blocks 41 and 43. The template also has a pair of apertures 57 and 58 therein. Stripper blocks 47 and 48 project into aperture 57. Stripper blocks 49, 51 and 52 project into aperture 58. Support rail 34 is nailed and glued to the face of template 33, as is an identical support rail 59. As with the side and rear trim stripper blocks, these may be 1 and ⅜ inch wide, but are preferably 1 and ⅞ inch high hardwood plywood. Each of them is provided with four apertures such as 65 with an aligned aperture and a T-nut in the template to receive cap screws for attaching U-straps thereto for securing the rails to the template support bars 18 (FIGS. 1 and 2).

Three lock-up plates 61, 62 and 63 are provided according to a feature of this invention. Plate 61 is secured to stripper block 46 by two cap screws 64. Template 33 is also secured to plate 61 by two cap screws 66. Similarly, lock-up plate 62 is secured to the back trim stripper block 43 by two cap screws 67. It is secured to the template by two cap screws 68. Likewise, lock-up plate 63 is secured to side trim stripper block 37 by two cap screws 69. The two cap screws 71 secure plate 63 to the template board 33.

Figure 5:
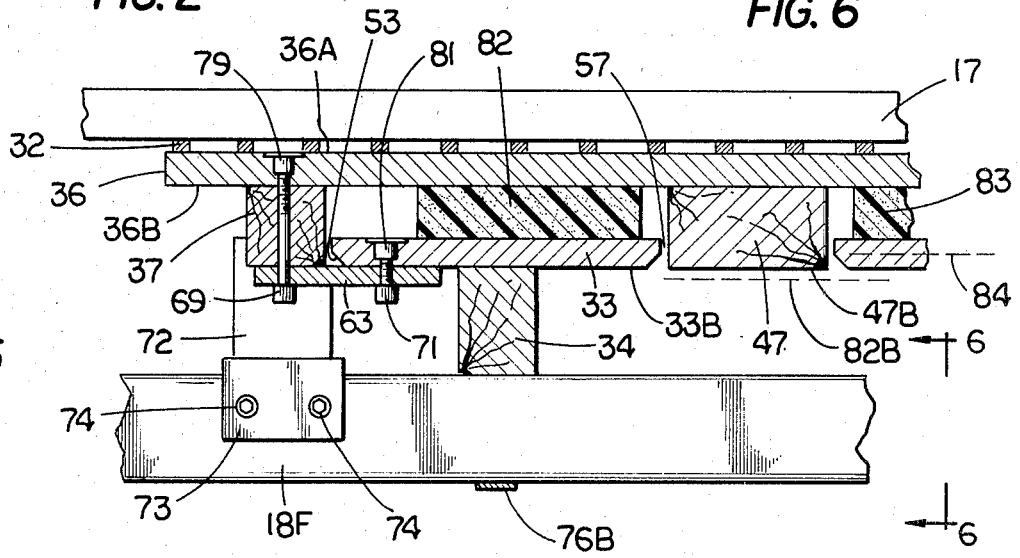
FIG. 5 is a fragmentary section through the stripping die and assembly taken at line 5—5 in FIG. 3, but further enlarged and also including portions of the support members of the press stripping station.

Referring now to FIG. 5, which is a section taken at line 5—5 in FIG. 3 and viewed in the direction of the arrows, it should be noted that this section shows the stripper assembly in the normal attitude it has when installed in the stripping station. In fact, although not shown in FIG. 3, FIG. 5 also shows the stripping die support member 17 of the stripping station of FIG. 1, and a template support bar 18 of the stripping station. In addition, FIG. 5 shows a trim strip breaker knife 72 mounted on a bracket 73, secured to the support bar 18 by a pair of Allen-head set screws 74.

Figure 6:
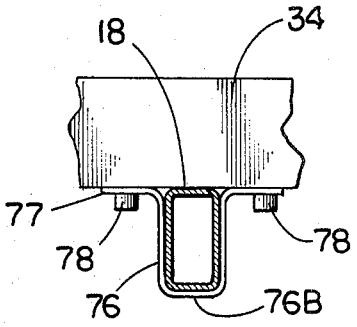
FIG. 6 is a fragmentary view at line 6—6 in FIG. 5 and showing the attachment of the template support rail to a support bar of the stripping station.

FIG. 6, which is a fragmentary elevational view of a portion of the assembly FIG. 5, shows the way support rail 34 is secured to the support bar 18. This is done by U-shaped straps or clamps 76 received under the support bar 18 and having ears or laterally extending tabs 77 secured to the support rail 34 by cap screws 78. The bottom horizontal portion 76B of the strap is shown in FIG. 5. The cap screws 78 are received in the aperture such as 65 mentioned above with reference to FIG. 3. Two such straps are used for each of the support rails 34 and 59 to secure them to the two support bars 18.

Figure 4:
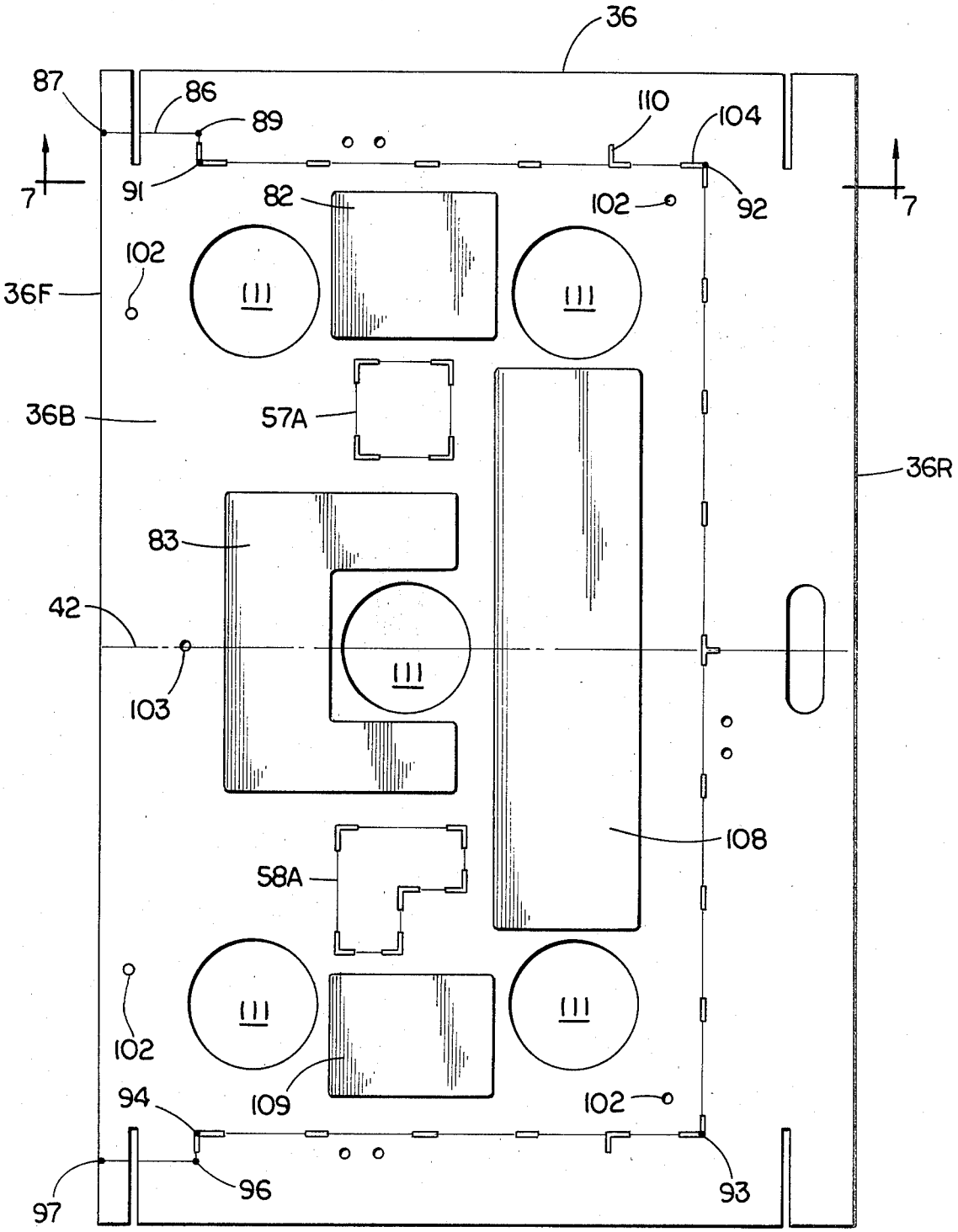
FIG. 4 is a bottom plan view of the stripping die of FIG. 3, but without the template.

With further reference to FIG. 5, it will be noted that each of the cap screws 69 and 71 is threadedly received in a corresponding T-nut 79 and 81, driven respectively into the top of the stripping die board 36 and template 33. Although not shown, each of the cap screws 78 (FIG. 6) is also threaded into a T-nut mounted in the template 33 just like T-nut 81. Also, the lower face 33B of the template is co-planar with the plane of the bottoms of the stripping blocks 37 and 47. The lock-up plates 63 establish and maintain this flush relationship when the cap screws 69 and 71 are tight, as well as the additional cap screws 64, 66, 67 and 68 referred to above with reference to FIG. 3. Resilient blocks 82 and 83, hidden in FIG. 3 but shown in FIG. 4, are secured to the bottom face 36B of the stripping die support board 36. These are shown compressed slightly, as they are when the template is locked in place by the lock-up plates. During the operation of the stripping die, they normally extend to a plane such as 82B slightly below the plane of the faces of the stripper blocks, in order to lightly engage the face of the sheet to be stripped before the stripper blocks pass through the plane and through the sheet and apertures in the template. As an example, they can be made of polyurethane "upholstery-foam" normally 2 inches thick when not compressed.

In FIG. 5, one can also see that the edge 53 of the template is beveled inward for slightly more than half the height of the edge. The same is true of the template edge at the aperture 57, entirely around the perimeter of this aperture. The purpose of this is to facilitate stripping of the waste at these locations, and avoid hanging up of the waste material on the stripper template, particularly in cases where the stripping blocks do not pass through the plane of the lower face 33B of the template. In fact, it enables utilization of the assembly with the stripper blocks passing only slightly below the plane 84 of the locations where the edges begin their taper away from the edge of the waste material. FIG. 3 shows this beveled edge around apertures 57 and 58, and around most of the perimeter of the template.

OPERATION

According to the procedure according to a typical embodiment of the present invention, the design from blueprints or other specifications of the corrugated box or other product to be fashioned in the press, is drawn on the cutting die board such as die board 86 in FIG. 1. Of course, the die board is not in the press at the time. Then a sheet of durable transparent material is secured on the die board. Mylar sheet is satisfactory for this purpose and a thickness of 0.005 inches is preferable. This sheet can be taped to the board. The cutting die drawing appearing on the die board is then traced onto the Mylar sheet. At the same time, appropriate reference lines from the die drawing are placed on the transparent sheet. At a minimum, these would be the X and Y horizontal coordinates needed to line-up the die board and the stripper assembly with the platens at the cutting station and stripping station, respectively.

Following completion of the tracing on the Mylar sheet, it is secured on the bottom 36B of the male stripping board 36. To do this conveniently, the board should be upside down. The orientation of the Mylar sheet on the board will depend upon whether the tracing was made with the die board rightside up or upside down, depending upon the orientation of the cutting die in the press during operation. The transparency of the Mylar sheet facilitates this step, regardless of the normal orientation of the cutting die in the press.

With the Mylar sheet on the stripping board 36, corners of the pattern are pinpointed by simply punching a pin through the Mylar sheet into the stripping board. In FIG. 4, a dot is shown at each such corner. Then the sheet is removed and lines are drawn on the board face 36B connecting the points, as needed, to reproduce the same pattern of the die which appeared on the Mylar sheet. This same procedure, using the Mylar sheet for the pinpointing, is performed on face 33B of the template board 33. The corners are pinpointed just as they were on the board 36. Then the sheet is removed and lines are drawn on the template board. The result is that, as shown in FIG. 4, for the stripping board, a line 86 is drawn from point 87 at the front edge 36F of the stripping board 36 to the points 89, 91, 92, 93, 94, 96, and back to the point 97 at edge 36F. The center line 42 is drawn from the front edge to the rear edge 36R. For this particular board assembly, the front edge is the other reference line for the board and the pattern thereon. A rectangle 57A is drawn using the four corner pinpoints provided. The FIG. 58A is also drawn using pinpoints provided for it. The same drawing is done on the template board.

After the appropriate lines are drawn on both of the boards, the Mylar sheet is placed on each of the boards separately and checked to see if the drawing on the board is exactly the same as that on the sheet. If it is, sawing can begin.

First, the template is sawed with a jigsaw using a suitable blade, depending upon customer requirements. This may be a 3 pt., 4 pt., 6 pt., 8 pt. or larger, depending upon the customer's needs. For the side trim edges such as 53 and 54 and back from edge 56 of the template, the cut is made on the center of the line, as is true also for the apertures. In this way the template will be just the right size for the die cut on the sheet stock and accommodate easy removal of the waste material.

Figure 7:
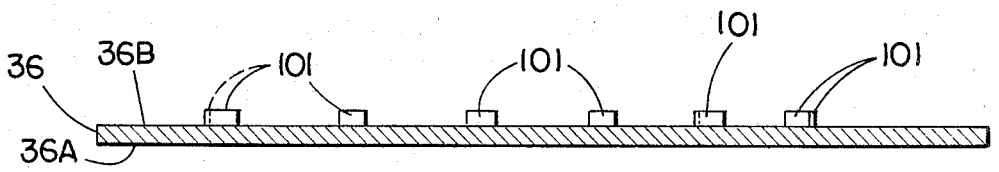
FIG. 7 is a section through the stripping board 36 taken at line 7—7 in FIG. 4.

Then the board 36 is cut with a jigsaw using the same size blade, making small rectangular cuts at appropriate places such as shown along lines 86, 57A and 58A in FIG. 4. These cuts should be centered on the lines drawn on the board. This is followed by insertion of metal alignment pieces in each of the saw cuts. Some of these pieces are shown in the edge view of FIG. 7. Their thickness is sufficient that they are snugly fitted into the saw cuts and project out of the face 36B. With these pieces in place, the template is placed on top of the board 36. It should fit precisely within the area defined by the pieces set in the saw cuts on line 86, and the apertures 57 and 58 should precisely frame the areas defined by the lines 57A and 58A where the metal pieces are also installed in the saw cuts. If the saw cuts are precisely centered on the lines on board 36, and if they are of the same thickness as the saw blade used on the template, there will be just enough clearance between the metal pieces and the template edges to enable placement of the template inside the pattern of locator pieces 101. Once this has been done, it confirms that the stripping die and template are matched exactly as possible.

With the boards 36 and 33 placed as described above, four holes of ¼ inch diameter are drilled through both boards with a drill press exactly 90° to the boards. This can be done at the locations 102 in FIG. 3, for example. An additional hole can be drilled at 103, if desired. The particular locations of these holes are not critical, the important thing being that the two boards do not move relative to each other during the drilling thereof. It is preferable that the holes be located so bolts used in them be accessible when the stripper assembly is in the press. Then the boards are separated from each other.

Then stripping die board 36 is turned over with face 36B down. At each of the ¼ inch holes, a countersink is made with a 13/16 inch die spade bit. Then, in each of the holes, a ¼ inch diameter-twenty thread per inch (¼–20) T-nut is driven. The head of the T is flush with the top 36A of the board. Then the board is inverted again, so the face 36B is up.

The next step is to install the stripper blocks. These blocks are located against the metal pieces. For example, block 37 is located against the two metal pieces forming a corner at point 91, and against the metal pieces in the line extending toward rear edge 36R from that point. Block 38 is located against the metal piece at 110 in FIG. 4, which lies in a plane parallel to the edges 88 and 98. It is also placed against the pieces 103 and 104, the latter being at the point 92. In this way, the side trim stripper blocks 37 and 38 are located so as to be effective to strip side trim and at the same time, with the gap 106 between the ends of these two blocks, a trim breaker knife can be accommodated as the stripping die assembly is closed at the stripping station. Such knife would be parallel to the knife 72 (FIG. 5) and in line with it, but on the bar 18R, rather than 18F. The rest of the stripper blocks are installed in the same way, being located against the appropriate metal pieces outside the various portions of line 86, and inside the various portions of lines 57A and 58A in FIG. 4. These are glued and nailed to the board 36 and are 1 and $\frac{3}{8}$ inches high from the face 36B of the board.

Following the installation of the stripper blocks, four or five 2 inch square blocks of wood, $\frac{7}{8}$ inch high and predrilled with $\frac{1}{4}$ inch diameter holes, are placed over the $\frac{1}{4}$ inch diameter holes previously drilled at 102 and 102 in board 36. Then, when the template is placed on top of the $\frac{7}{8}$ inch high blocks, the template face 33B will be coplanar with the stripper block faces. Then, $\frac{1}{4}$–20 bolts are inserted through the holes 102 and 103 in the template, the support blocks, and received in the T-nuts previously installed at locations 102 and 103 in the board 36. They are then made snug, resulting in the template and stripper die being precisely lined up vertically, so center line 42 on the board 36 is lined up with center line 42A on board 33, and the front edges 36F of board 36 and 33F of board 33 are vertically aligned.

The next step is preparation of the lock-up plates. For this purpose, three pieces of aluminum, $\frac{3}{8}$ inch thick and 2 inches wide by 3 and $\frac{1}{2}$ inches long and pre-drilled with four $\frac{1}{4}$ inch diameter holes, are placed on the stripper blocks such as 37, 43 and 46 as shown in FIG. 3. A $\frac{1}{4}$ inch drill is passed through one of the holes in each plate and drilled through the stripper block and board 36. Then the plates are removed and the stripper die inverted to countersink the holes and install $\frac{1}{4}$–20 T-nuts, as described above.

The stripper die is then inverted, and the three aluminum plates are secured to the stripper blocks with $\frac{1}{4}$ inch cap screws threaded into the T-nuts. Then, a second $\frac{1}{4}$ inch hole is drilled into the stripper wood through the other hole of the pair in each of the lock-up plates, this hole being drilled entirely through the stripper wood and board 36, just as previously described for the first hole. Then the assembly is inverted and the holes countersunk on face 36A, and the T-nuts installed. Then it is inverted again and $\frac{1}{4}$ inch cap screws installed. At this point, the plates have been secured to the stripper blocks by the cap screws 69 in the case of plate 63, and 67 and 64 in the cases of plates 62 and 61, respectively.

The next step is to drill two holes through template board 33 at the locations of each of the other two holes in the lock-up plates. Then bolts are removed from the holes at 102 and 103, board 33 is removed and inverted and countersunk around the two holes at each of the three lock-up plate locations, and T-nuts are installed. Then the board 33 is again inserted in the space framed by the stripper blocks, and the plates 61, 62 and 63 are re-installed and the cap screws tightened. In order that the same lock-up plates be located in the same locations each time, each plate should bear a number, and the corresponding stripper part should bear the same number distinguishing the location. For example, plate 61 bears the number "1" and the template is marked with the number "1" adjacent to mounting holes for plate 1. The same is done for plates 62 and 63, with the numbers "2" and "3" at their respective locations. It may also be advisable to mark the stripper blocks with the same numbers at the respective locations. In this way, the plates can always go on the stripper die and template at the correct locations and rightside up.

The resilient release blocks 82 and 83 which have previously been mentioned, are located on the face 36B of the stripper die board 36 in order to help release the stripped sheet from the stripping blocks as the stripping station opens. Additional such blocks as at 108 and 109 can be employed, and still more such blocks can be employed at appropriate locations. Also, four circular apertures 111 are shown in FIG. 4. They prevent creation of vacuum which might otherwise interfere with the work. The four slots in the board edges can be used for clamping the board 36 to a grid in the support member 17.

The bolts 103A and 105, as well as the other two front bolts at locations 102 near the edge 36F of the assembly, can be installed and/or removed when and if needed for convenience. The stripper assembly can be conveniently hand carried by the hand hole 112 in the board 36.

Since the assembly, as secured together by the lock-up plates 61, 62 and 63, is perfectly aligned, it is a feature of the present invention that this assembly not be separated until it has been completely installed in the stripping station. For this purpose, with the stripping station open as shown in FIG. 1, the die board 36 is secured by bolts, clamps, or otherwise to grid 32 on support member 17. The center line 42 thereof is aligned with the center line of the grid on member 17. Then, the actuating mechanism is jogged to raise the support bars 18 to a point where they engage the bottom of the support rails 34 and 59 of the stripper assembly. Then the straps such as 76 are installed, two of them securing the support rails 34 and 59 to the bar 18F, and two of them securing the support rails 34 and 59 to the bar 18R. When the board 36 has been affixed to the grid, and the template support rails 34 and 59 have been affixed to the support bars 18, lock-up plates 61, 62 and 63 are removed. This is done by removing the cap screws from them. Also, if any of the bolts 103A and 105 are in place at this time, they too will be removed. The stripping station is thereupon ready to function to strip waste from sheets cut in the cutting station, for subsequent passage of the sheets to a further stripping station or collection station in the press.

Following completion of the cutting and stripping of the sheets required to complete a customer order, the stripping mechanism is jogged to the point where reassembly of the stripping die and template can be achieved. This, again, is the position shown in FIG. 5. The lock-up plates are again installed and tightened using the cap screws 69 and 71 for plate 63, and the other previously identified cap screws for the other plates. The retaining bolts can also be installed at the points 102 and 103. Then the U-straps can be released from the bars 18. Then the board 36 can be released from the grid 32. Then the die assembly can be lowered by lowering the support bars 18, and the stripper die assembly can thereupon be removed from the press. The cutting die can also be removed and these units then placed in storage until die cuts of the same configuration are again needed.

From the foregoing description, it can be seen that the present invention provides the means whereby the stripper die and template can be precisely made and assembled at the outset, retained in precise alignment for installation in the stripping station, retained in precise alignment during installation in the stripping station, remain in precise alignment while the stripping station is operating on work pieces, and restored to a precisely aligned assembly after operation of the stripping station. It thereby significantly reduces the skill required for incorporation in the press, the time required for installation in the press and minimizes risk of damage to the tooling or the work pieces.

It should be recognized that some minor changes in sequence of preparation and assembly of the stripping die assembly can be made without departing from the invention. In addition, for some purposes, it may be found possible to use only the bolts at locations such as 102 and 103 to establish and maintain alignment of the stripping die and template, and thus dispense with the lock-up plates. This may be particularly true if the overall height of the stripping assembly is not too great and the release pads such as 82, 83, 108 and 109 do not impart any skew to the respective parts as they are bolted together. The extent to which that kind of construction can be reliably used may vary with the particular size and shape of the die cut sheets to be stripped.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. One such change is applying the invention to a press where the upper platen, rather than the lower platen, in the stripping station, is movable.

What is claimed is:

1. A stripping assembly for in-line stripping apparatus of stripping stations in die cutting systems comprising:

a stripping die including a generally planar mounting member and waste stripper means on said mounting member;

a template including a planar member shaped to provide support for non-scrap areas of a work piece to be stripped; and fastener means retaining the mounting member and template in alignment when the assembly is separate from the stripping station of the system;

said stripper means including stripper blocks secured to said template, and said fastener means including:

a plurality of lock-up plates secured to said stripper means and said template; and means securing said lock-up plates to said stripper means and said template.

2. The assembly of claim 1 wherein:

said mounting member is a board, and said planar member of said template has a surface which faces said board, and said template includes a pair of support rails on a surface thereof on the side opposite the surface which faces said die board, said support rails having means thereon facilitating attachment thereof to support bars in a stripping station of a die cutting and stripping system.

3. A stripping assembly for in-line stripping apparatus of stripping stations in die cutting systems comprising:

a stripping die including a generally planar mounting member and waste stripper means on said mounting member;

a template including a planar member shaped to provide support for non-scrap areas of a work piece to be stripped; and fastener means retaining the mounting member and template in alignment when the assembly is separate from the stripping station of the system, said template being under said planar member and having a beveled edge at the underside thereof, to facilitate stripping of stock therewith.

4. The assembly of claim 3 wherein:

said planar member and stripper means and template are hardwood plywood.

5. The assembly of claim 4 wherein:

said fastener means include T-nuts driven into said planar member and into said template at the upper faces thereof, with the upper face of the template, including the T-nuts, being smooth and planar.

6. A stripping assembly for in-line stripping apparatus of stripping stations in die cutting systems comprising:

a stripping die including a generally planar mounting member and waste stripper means on said mounting member;

a template including a planar member shaped to provide support for non-scrap areas of a work piece to be stripped; and fastener means retaining the mounting member and template in alignment when the assembly is separate from the stripping station of the system, said mounting member and the planar member of the template being in vertically spaced parallel planes, the spacing of the planes while retained in secure alignment by said fasteners being no greater than the minimum spacing which would enable stripping scrap by the assembly from a die cut work piece supported on said planar member.

7. The assembly of claim 6 wherein:

said planar member of said template has a flat top area lying in a plane, and said stripper means project from said mounting member downward through the said plane of the said top area of said template.

8. The assembly of claim 7 wherein:

said template planar member shape is defined, in part, by lateral stripping edges, said stripper means projecting into the space adjacent said lateral stripping edges and leaving horizontal clearance space between said stripper means and said lateral edges.

9. The assembly of claim 8 wherein:

said stripper means having lower edges, and said lateral stripping edges are beveled from a level above said lower edges of said stripping means, toward the bottom of said planar member.

* * * * *